United States Patent [19]

Pauls et al.

[11] 4,202,852

[45] May 13, 1980

[54] PROCESS FOR PRODUCING COLORED NONWOVEN FIBROUS WEBS

[75] Inventors: Walter L. Pauls, Appleton; Fredric N. Miller, Menasha, both of Wis.

[73] Assignee: American Can Company, Greenwich, Conn.

[21] Appl. No.: 951,441

[22] Filed: Oct. 13, 1978

Related U.S. Application Data

[63] Continuation of Ser. No. 774,665, Mar. 4, 1977, abandoned.

[51] Int. Cl.[2] ..... D06P 7/00; D06M 11/16; B32B 23/14

[52] U.S. Cl. ..... 264/115; 162/162; 162/183; 264/78; 264/121; 264/122; 264/128; 264/131

[58] Field of Search ..... 264/115, 116, 118, 122, 264/128, 131, 136, 78, 119, 121; 162/162, 183; 428/207

[56] References Cited

U.S. PATENT DOCUMENTS

| | | | |
|---|---|---|---|
| 3,025,203 | 3/1962 | Leupold et al. | 264/128 |
| 3,088,859 | 5/1963 | Smith | 264/119 |
| 3,914,498 | 10/1975 | Videen | 264/128 |
| 3,963,819 | 6/1976 | Kroyer et al. | 264/115 |
| 3,966,912 | 6/1976 | Fair et al. | 264/128 |
| 3,976,734 | 8/1976 | Dunning et al. | 264/121 |

*Primary Examiner*—James B. Lowe

*Attorney, Agent, or Firm*—Robert P. Auber; Ira S. Dorman; George P. Ziehmer

[57] ABSTRACT

A process for coloring nonwoven webs of fibrous material, particularly air-layed webs, in which solid, water insoluble particulate pigments are introduced and intermixed with the fibers of the web to provide the coloring thereof. An initial formed web of fibrous material has a suspension of insoluble pigment in a liquid applied thereto, is fiberized, and is reformed into a web and bonded with a binding liquid. Alternatively, the pigment may be mixed with the separated fibers after the fibrous material is fiberized and before reforming.

3 Claims, No Drawings

PROCESS FOR PRODUCING COLORED NONWOVEN FIBROUS WEBS

This is a continuation of application Ser. No. 774,665, filed Mar. 4, 1977, now abandoned.

BACKGROUND OF THE INVENTION

1. Field of the Invention

This invention pertains generally to nonwoven fibrous webs, and more particularly to processes for coloring such nonwoven webs.

2. Description of the Prior Art

It is often desired to provide a nonwoven wiper which has greater thickness, bulk and absorbency than paper towels which are formed by the standard wet laying processes. To achieve greater bulk and absorbency, fibrous material may be air-layed in a substantially dry state to form a web, with the fibers of the web then being bonded together by a binder material, such as a polymeric latex which is applied in a liquid state to the web and is dried and cured with cross-linking of the polymer molecules. Typically, such webs are colored by applying dye solutions to the formed web and allowing the dyes to thoroughly soak into the web to color all of the fibers of the web.

In certain air-layed web forming processes, the purified pulp fibers are first formed into a heavy web which is subsequently dried to relatively low moisture content. The dried web is then run through a defiberizer such as a hammermill to reproduce the separated individual fibers, which are then blown down onto a moving fine screen on which the air-layed web is formed. The formed web is then pressed and the binding liquid is applied thereto to provide the necessary binding of the fibers. Such webs have also been colored by the application of dye solutions, either to the formed web, or to the initial pulp web before it is fiberized.

While dyes have been extensively used to provide the coloring in nonwoven webs, the dyes themselves present troublesome problems where the nonwoven webs are to be used in a wet environment, such as with household wipers. These wipers must maintain their structural integrity over a period of use in a wet environment, and must not be subject to bleeding of the coloring material or to rubbing off of the color onto the surface being cleaned. Because the dyes used in papermaking ordinarily must be nontoxic and are preferably relatively inexpensive to use in the large scales encountered in papermaking, the dyes actually utilized are water soluble and even after fixing do not have satisfactory bleed and rub resistance.

SUMMARY OF THE INVENTION

The process of this invention provides for coloring of nonwoven air-layed webs with pigmentary material such that the final web has a rub and bleed resistance superior to that obtained with dye colored webs. In accordance with our process for producing a pigmentary colored web, the surface of a dried and pressed formed web of fibrous material is sprayed with a suspension of water insoluble particulate color pigment in a liquid carrier, preferably water. The sprayed web may then be partially dried before being passed into a hammermill which fiberizes the web and thoroughly mixes it to form a mixture of individual fibers having pigment particles clinging thereto and fibers without pigment. The fiber and pigment mixture is then formed into a web, and water insoluble binding liquid is applied onto and through the web and is cured to bind the fiber and pigment particles together. The water insoluble binder firmly holds the pigment particles to the fibers of the web with the result that there is very little bleed or rub-off of any pigment under even the most extreme use conditions. The process may be varied by alternatively mixing the finely particulated pigment suspension with the separated and fiberized fibers, agitating the same to provide a uniform mixture, and then air-laying the mixture into a web and applying the binding liquid.

The resulting air-layed product has a desirable color fastness, and by virtue of the air-layed process, is thicker, bulkier and more absorbent than ordinary wet-layed toweling. The use of pigmentary coloring agents with small particle size does not interfere with the desirable qualities of such air-layed webs, and the pigments themselves are chosen to be water insoluble and preferably nontoxic so as to be completely compatible with consumer uses.

Further objects, features, and advantages will be apparent from the following detailed description illustrating preferred embodiments of our invention.

DESCRIPTION OF THE PREFERRED EMBODIMENT

In a preferred embodiment of our process, the pulp fibers that are to be formed into the air-layed nonwoven web are initially compacted into a pulp sheet and substantially dried to remove most of the water from the web. The pulp sheet or web will contain in the range of 4 to 10% water on the dry weight of the fibers. The fibers utilized can be those obtained from standard processes for the production of wood pulp fiber, but our process is not limited to wood pulp fiber, and various other natural fibers and synthesized fibers such as rayon and other synthetics, as well as mixtures of synthetics and natural fibers, can be utilized in this process.

In the air-layed nonwoven web forming process, the dry pulp fiber web is passed into a fiberizer such as a hammermill, a pin cylinder, or a saw tooth cylinder, to completely mix and fiberize the individual fibers of the web. The separated fibers are transferred to a forming apparatus to evenly distribute the fibers onto a moving fine wire screen to form the web. Vacuum may be applied under the moving screen to further draw the dry fibers onto the screen and maintain them there. After the web is formed on the screen, it is passed through the nip of a pair of upper and lower rollers to provide some compaction and slight bonding of the fibers of the web. The process is customarily adjusted such that slight amounts of moisture will be present even in the air-layed webs to allow some mositure bonding of the fibers to occur when the fibers are pressed together. After forming, the web is passed through a binder applicator which sprays on a binding liquid in uniform distribution onto and through the fibers of the web. Roller applicators may also be used to apply the binding liquid, although minimal roller pressure is preferred to maintain the bulkiness of the air-layed web. To provide cross-linking of the molecules of the binder and consequent bonding together of the fibers of the web, the web is customarily passed into a drying oven where the curing conditions of heat and hot moving air in the oven cause evaporation of the solvent and the cross-linking to occur. To insure thorough and uniform distribution of binder within the web, it is customary to apply binding liquid to both sides of the web. Thus, substantially all of the fibers of the web will be in contact with the binding liquid, and will be bound together to form a final product which has relatively significant cohesive integrity, while maintaining excellent bulk and absorbency because of the minimal compression of the fibers during the air-laying process.

In a preferred embodiment of our process, a water insoluble particulate colored pigment is dispersed and suspended in a liquid carrier such as water to allow initial application and adhesion of the pigment to at least some of the fibers. The pigment selected may be any type of approved nontoxic color pigment which is insoluble in water and in most common household solvents. The pigment is further chosen to be of a particle size which is substantially smaller than the mean size of the pulp fibers being colored, with a common preferred pigment particle size being in the range of 0.1 to 0.5 microns.

The pigment in carrier suspension can be applied to the formed fibrous pulp web by spraying thereon, or by other common means of application such as saturation in a pigment suspension bath, coating by means of rotogravure, or other common application methods which will provide a coating of pigment over at least one surface of the pulp fiber web. Because of the mixing of the pigmented and unpigmented fibers, it is not necessary that the coating be uniform. It is expected that the pigment suspension will not soak through and be in contact with all of the fibers of the pulp web, and it is not necessary that such thorough soaking of the web take place. However, to vary the intensity of the color in the resulting final air-layed product, it may be desired to apply a heavier coating of the pigment suspension to only one surface of the web, or to apply a pigment coating to both surfaces of the web, as necessary to obtain the requisite degree of color intensity.

The fiberization of the pigment coated web is generally carried out in a fiberizer such as a hammermill or a pin mill, and such equipment is generally adapted to work best where the water content of the web being fiberized is less than approximately 15% on the dry weight of the material in the web. Thus, it may be necessary and desirable to apply heated air or heat alone to the coated web before it is passed into the fiberizer. The application of heat and air may be adjusted to reduce the moisture content down to a desired level. As indicated above, it is often desired to allow a certain degree of moisture to remain with the fiberized and separated fibers to allow the proper formation of the air-layed web. The application of the pigment in suspension with water (or other liquid carrier) provides some initial adhesion of the pigment particles to the fibers of the pulp web which are at or near the surface of the web. As the pulp fiber web is passed into the fiberizer, the fibers having pigment particles adhering thereto are broken from the other fibers of the web and are thoroughly intermixed with the other fibers. The thorough mixing of all of the fibers results in a uniformly colored product after air-laying.

Alternatively, a substantially dry mass of fibrous material may be passed into the fiberizer and the fine particulate pigment may be intermixed with the shredded fibers in the fiberizer, and thoroughly intermixed therewith, before the fibers are transported to the air-laying apparatus. This may be generally accomplished by injecting a stream of particulate pigment in suspension in a liquid carrier into the fibers exiting from the hammermill, and before the fibers are blown into the pipe which takes them to the air-laying station. The pigment in liquid (preferably water) suspension mixed with the fibers will result in at least some of the fibers having pigment particles adhered thereto. The thorough mixing in the fiberizer will again result in a uniform mixture of pigmented and unpigmented fibers.

After the fibers have been formed into a web on a moving screen, the binder liquid is applied onto and through the web to provide the requisite binding together of the fibers of the web as well as binding the solid pigment particles firmly to the fibers. The binder chosen may be any material which is water insoluble and provides strong binding strength after curing. Where the end product is to be utilized for kitchen toweling and the like, the binder itself must be compatible with common household chemicals, and of course, nontoxic. Examples of satisfactory binding materials are polymer latices such as acrylonitriles, acrylics, styrene-butadiene, and ethylene vinyl acetate and water soluble resins such as polyvinyl alcohol with melamine-formaldehyde resin to insolubilize it. These materials, and others similar to them, provide the necessary cross-linking and insolubility upon curing which traps the pigment within the web, and insures that the pigment will not be released in water or other common household materials and that it will be firmly held to the fibers of the web to prevent mechanical rub-off during household uses of the product. The thorough mixing of the pigment with the fibers, whether before or after introduction into the hammermill, is necessary to obtain uniform coloration of the finished web. We have determined that it is not desirable to add the pigment directly to the latex binder before application of the binder since it is difficult to obtain uniform coverage of the binder upon the web, thus resulting in readily apparent streaks and spots of color in the finished product. Moreover, where the pigment is to be mixed with the binder, the range of pigments and binder materials which may be utilized is limited because of the necessity of obtaining chemical compatibility of the two materials. This is not a problem where the pigment is first applied to the fibers of the web, with the binder then being applied to the formed web and cured immediately thereafter.

The following examples are provided as illustrative of the invention, but are not to be construed as being exhaustive or as limiting the invention to the specific details thereof.

EXAMPLE I

A web of fibrous pulp materials consisting of Ray-Floc XJ with a basis weight of 550 lbs. per ream was sprayed on one surface thereof with a suspension consisting of 10.4% Ciba-Geigy Tintolite yellow G 96 pigment and 89.6% water. The solution add-on to the pulp sheet was approximately 13.2% on the dry weight of the pulp web, with about 1.37% of color pigment added to the dry weight of the pulp.

Immediately after spraying, the colored fiber pulp web was fiberized in a 10 inch Buffalo hammermill which thoroughly shredded and fiberized the pulp web and mixed the fibers containing pigment with the fibers that were not colored. Approximately 10 to 30% of the fibers have color added thereto initially, but after fiberizing, the colored fibers and unpigmented fibers are thoroughly mixed to provide a uniformly colored fiber mass.

The colored, fiberized mixture was formed into handsheets, and the sheets had a binder consisting of an acrylonitrile latex, B. F. Goodrich 1572×45 applied to both sides thereof. The sheets were air dried overnight, and after drying, were cured for 60 seconds at 320° F. in order to provide cross-linking of the latex. The resulting bonded sheet was composed of approximately 36 lbs. per ream of fibrous materials and 8 lbs. per ream of binder solids.

Bleed and rub tests were conducted using various household materials including 1% Ivory soap solution at 185° F., water at 185° F., and hot hamburger grease. The pigmented handsheets had no bleed with hamburger grease and hot water and very little bleed with hot Ivory soap solution. Virtually no rub-off of pigment was observed with any of the materials tested when the sheets were rubbed against clean surfaces.

EXAMPLE II

A pulp web was provided consisting of Stora Fluff manufactured by Stora-Kopperberg, having a 60 cm. width with a basis weight of 515 lbs. per ream, and containing about 6% moisture on the dry weight of the web. An Avocado coloring solution consisting of the following pigment ingredients was prepared: 5.71% Ciba-Geigy G96 yellow, 2.40% Ciba-Geigy 123 blue, 1.01% Ciba-Geigy G55 orange, intermixed, dispersed and suspended in 90.88% water. The pigment suspension was sprayed onto the pulp web moving at 4 meters per minute with an application rate of 80 ml. per minute. After being sprayed with the pigment suspension, the pulp web was passed under infrared heaters to provide substantial drying of the web, and then was passed into a hammermill fiberizer.

The fiberizer thoroughly shredded and fiberized the pulp web and mixed the pigmented fibers with the uncolored fibers to result in a uniform fiber mass. The fiber mass was then air-layed onto a sheet forming line moving at 36 meters per minute, and an ethylene vinyl acetate latex, Airflex A120, diluted to 20% solids, was applied to one side of the web and dried by application of hot air. The latex was then applied to the other side of the web and again dried by application of hot air. The dried web was cured by being passed through an oven at a temperature of 265° F. The resulting sheet had a basis weight of 80 grams per sq. meter. The resulting web was treated with various materials including hot water at 185° F., milk, hot bacon fat, soap, ammonia, hamburger grease, and scouring powder. No color bleed or color transfer upon rub was obtained, as contrasted to the significant bleed and transfer on rubbing commonly associated with conventionally dyed toweling.

It is understood that our invention is not confined to the particular embodiments described herein as illustrative of the invention, but embraces all such modifications thereof as may come within the scope of the following claims.

We claim:

1. A process for producing a colored non-woven air laid fibrous web, comprising the steps of:
   (a) providing a pulp web formed of a compacted mass of individual pulp fibers;
   (b) applying to only a portion of the pulp web a water suspension of non-toxic water-insoluble color pigment particles having a size range of 0.1 to 0.5 microns to thereby apply an adherent coating of said pigment particles to a portion of the pulp fibers in said web while leaving a portion of said fibers uncoated;
   (c) heating said pigmented web to reduce the water content thereof to less than approximately 15% of the dry weight of the material in the web;
   (d) feeding said dry pigmented web into a fiberizer to break down said web into individual pulp fibers and to uniformly mix the pigment-coated fibers with the non-coated fibers to produce a substantially uniformly colored fiber mixture;
   (e) air laying the uniformly colored fiber mixture to form a uniformly colored web;
   (f) applying a water insoluble liquid polymer binder material onto both sides of the web and through the web; and
   (g) curing the binder material to bind the fibers together and firmly bond the pigment particles onto the coated fibers of the web to form a bleed resistant and run resistant uniformly colored air laid web.

2. The process of claim 1 wherein the water suspension of non-toxic water-insoluble color pigment particles is sprayed onto one surface of the pulp web.

3. The process of claim 2 wherein the pulp web has a moisture content of from 4 to 10% water based on the dry weight of the pulp fibers prior to the application of the water suspension of non-toxic water-insoluble color pigment particles.

* * * * *